US012253076B2

(12) United States Patent
Wang et al.

(10) Patent No.: US 12,253,076 B2
(45) Date of Patent: Mar. 18, 2025

(54) EMULSION PLUNGER PUMP AND PUMP HEAD ASSEMBLY THEREOF

(71) Applicants: CCTEG BEIJING TIANMA INTELLIGENT CONTROL TECHNOLOGY CO., LTD., Beijing (CN); BEIJING CCRI-TIANMA AUTOMATION TECHNOLOGY CO., LTD., Beijing (CN)

(72) Inventors: Chuliang Wang, Beijing (CN); Ran Li, Beijing (CN); Wenshu Wei, Beijing (CN); Hao Liu, Beijing (CN); Jian Ye, Beijing (CN); Mengyu Wu, Beijing (CN); Rongming Chen, Beijing (CN); Bo Liu, Beijing (CN)

(73) Assignees: CCTEG BEIJING TIANMA INTELLIGENT CONTROL TECHNOLOGY CO., LTD., Beijing (CN); BEIJING CCRI-TIANMA AUTOMATION TECHNOLOGY CO., LTD., Beijing (CN)

( * ) Notice: Subject to any disclaimer, the term of this patent is extended or adjusted under 35 U.S.C. 154(b) by 89 days.

(21) Appl. No.: 18/028,166

(22) PCT Filed: Apr. 12, 2021

(86) PCT No.: PCT/CN2021/086361
§ 371 (c)(1),
(2) Date: Mar. 23, 2023

(87) PCT Pub. No.: WO2022/073328
PCT Pub. Date: Apr. 14, 2022

(65) Prior Publication Data

US 2023/0366394 A1 Nov. 16, 2023

(30) Foreign Application Priority Data

Oct. 9, 2020 (CN) ..... 202011073265.6

(51) Int. Cl.
*F04B 9/02* (2006.01)
*F04B 53/10* (2006.01)

(52) U.S. Cl.
CPC ..... *F04B 53/1022* (2013.01); *F04B 9/02* (2013.01); *F04B 53/109* (2013.01)

(58) Field of Classification Search
CPC ..... F04B 53/109; F16K 15/028; F16K 15/021
See application file for complete search history.

(56) References Cited

U.S. PATENT DOCUMENTS 3,216,365 A * 11/1965 Dettinger ..... F04B 53/109 92/147
3,399,694 A * 9/1968 Vinson ..... F04B 53/102 417/539

(Continued)

FOREIGN PATENT DOCUMENTS

CN 203796550 U * 8/2014
CN 106438338 A * 2/2017

(Continued)

OTHER PUBLICATIONS

Stefano Pinna, "Search Report for EP application 21876851.3", Sep. 24, 2024, EPO, Germany.

(Continued)

*Primary Examiner* — Thomas Fink
(74) *Attorney, Agent, or Firm* — Bridgeway IP Law Group, PLLC; Jihun Kim

(57) ABSTRACT

An emulsion plunger pump and a pump head assembly (100) thereof. The pump head assembly (100) includes a pump head body (101), a liquid suction valve assembly (102), a liquid discharge valve assembly (103), a spacer sleeve assembly (104), and an end cover (105); the pump head body (101) has a hollow chamber (101*a*); the liquid suction valve assembly (102), the spacer sleeve assembly (104), and the liquid discharge valve assembly (103) are sequentially (Continued)

installed in the hollow chamber (101*a*); the liquid suction valve assembly (102) includes a liquid suction valve seat (1021), a liquid suction valve core (1022), and a first reset spring (1023); the liquid suction valve core (1022) is slidably connected to the spacer sleeve assembly (104); the first reset spring (1023) is located between the spacer sleeve assembly (104) and the liquid suction valve core (1022); and the end cover (105) is detachably connected to one end of the pump head body (101). The pump head assembly (100) is reasonable in internal structure and long in service life.

7 Claims, 5 Drawing Sheets

(56) References Cited

U.S. PATENT DOCUMENTS 4,477,236 A * 10/1984 Elliott ..... F04B 53/103 417/454
4,618,316 A * 10/1986 Elliott ..... F04B 53/103 417/454
6,193,483 B1 2/2001 Michael
8,147,226 B2 * 4/2012 Koka ..... F04B 9/02 417/571
2005/0229975 A1 * 10/2005 Moe ..... F16K 15/066 137/454.4
2014/0271266 A1 * 9/2014 Young ..... F04B 53/14 417/360
2020/0386221 A1 * 12/2020 Pham ..... F04B 53/14

FOREIGN PATENT DOCUMENTS

| | | | | |
|---|---|---|---|---|
| CN | 106949032 | A | * | 7/2017 |
| CN | 206439170 | U | | 8/2017 |
| CN | 207048915 | U | * | 2/2018 |
| CN | 107842493 | A | * | 3/2018 |
| CN | 109989912 | A | * | 7/2019 |
| CN | 111608903 | A | * | 9/2020 |
| CN | 111734598 | A | | 10/2020 |
| CN | 111734599 | A | | 10/2020 |
| CN | 111734621 | A | | 10/2020 |
| CN | 112081739 | A | | 12/2020 |
| CN | 212479545 | U | | 2/2021 |
| DE | 3448016 | A1 | | 6/1986 |
| GB | 1462145 | A | | 1/1977 |
| WO | WO-03081047 | A1 | * | 10/2003 ..... F04B 53/109 |

OTHER PUBLICATIONS

Examiner, "OA for CN application 202011073265.6", Dec. 14, 2024, CNIPA, China.

* cited by examiner

EMULSION PLUNGER PUMP AND PUMP HEAD ASSEMBLY THEREOF

CROSS-REFERENCE TO RELATED APPLICATION

This application is a U.S. National Phase application of International Patent Application No. PCT/CN2021/086361 filed on Apr. 12, 2021, which claims priority to and benefits of Chinese Patent Application Serial No. 202011073265.6, filed with CNIPA on Oct. 9, 2020 and titled "Emulsion Plunger Pump and Pump Head Assembly Thereof," the entire contents of which are incorporated herein by reference.

FIELD

The present disclosure relates to a field of design and manufacture of emulsion pumps, and more particularly to an emulsion plunger pump and a pump head assembly thereof.

BACKGROUND

In recent years, with more and more working faces with large mining height in China, in order to meet the requirements of high support resistance and high working resistance of hydraulic supports with large mining height, as well as rapid support moving and safety support, higher demands in terms of the reliability of emulsion pump stations have been put forward. An emulsion pump provides hydraulic power for the hydraulic support of the working face, and is the heart of the hydraulic system for the whole working face. An emulsion plunger pump is a device that uses emulsion or water as a medium, does work on the emulsion through an internal structure of a crankcase, and then converts it into hydraulic energy of the emulsion.

SUMMARY

According to a first aspect of the present disclosure, a pump head assembly of an emulsion plunger pump includes: a pump head body having a hollow chamber; a liquid suction valve component; a liquid discharge valve component; a spacer sleeve component; and an end cover detachably connected to an end of the pump head body and configured to close the hollow chamber. The liquid suction valve component, the spacer sleeve component and the liquid discharge valve component are sequentially mounted in the hollow chamber. The liquid suction valve component includes a liquid suction valve seat, a liquid suction valve core and a first reset spring, the liquid suction valve core being slidably connected to the spacer sleeve component, and the first reset spring being between the spacer sleeve component and the liquid suction valve core.

According to a second aspect of the present disclosure, an emulsion plunger pump includes a crankcase assembly connected to a main drive motor; a pump head assembly for pumping emulsion; and a hydraulic conversion assembly having a first end connected to the crankcase assembly and a second end connected to the pump head assembly. The pump head assembly includes: a pump head body having a hollow chamber; a liquid suction valve component; a liquid discharge valve component; a spacer sleeve component; and an end cover detachably connected to an end of the pump head body and configured to close the hollow chamber. The liquid suction valve component, the spacer sleeve component and the liquid discharge valve component are sequentially mounted in the hollow chamber. The liquid suction valve component includes a liquid suction valve seat, a liquid suction valve core and a first reset spring, the liquid suction valve core being slidably connected to the spacer sleeve component, and the first reset spring being between the spacer sleeve component and the liquid suction valve core.

BRIEF DESCRIPTION OF DRAWINGS

Embodiments of the present disclosure will be described below in detail with reference to the accompanying drawings, which will help to understand the objectives and advantages of the present disclosure, wherein.

DETAILED DESCRIPTION

Figure 1:
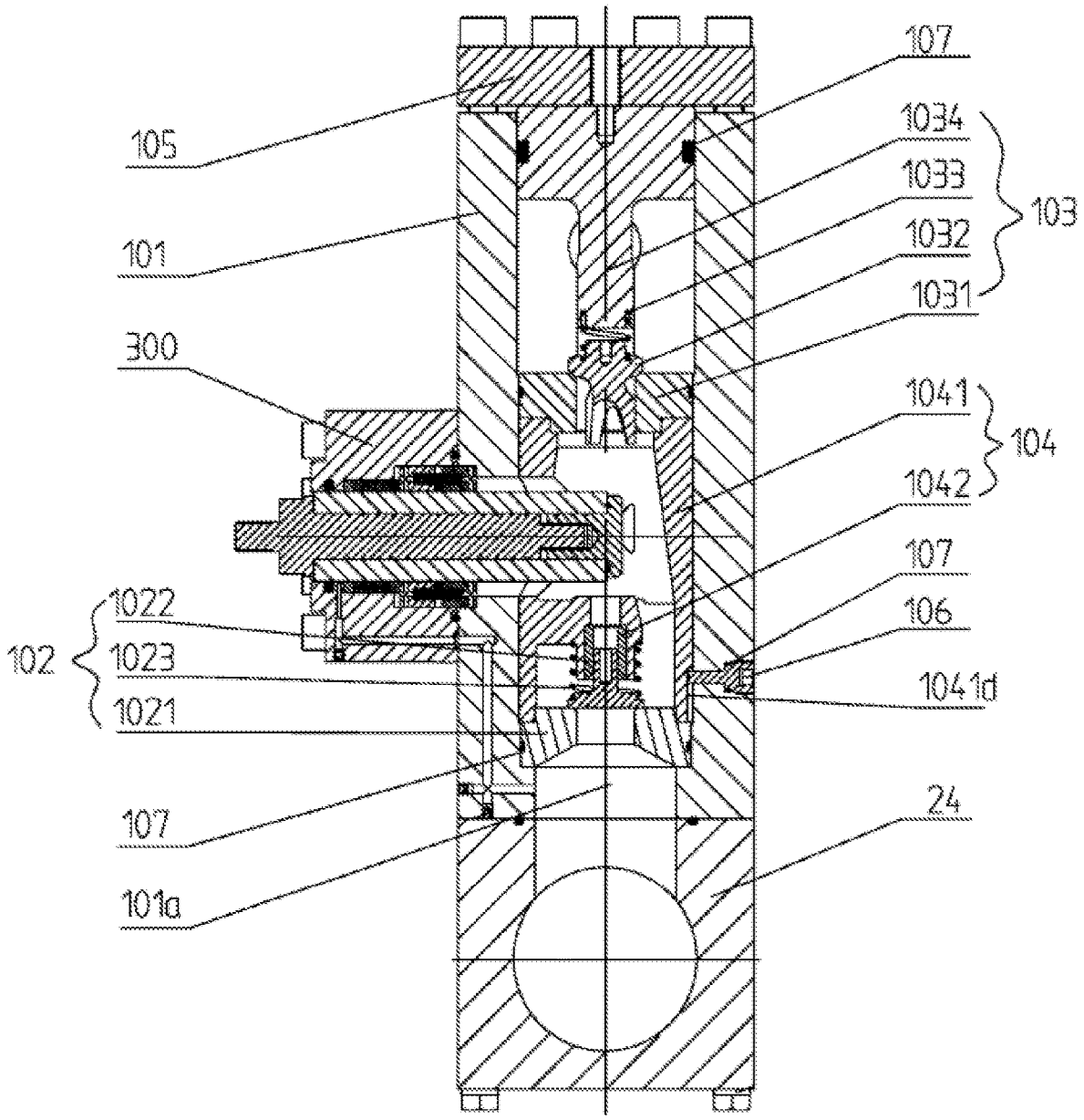
FIG. 1 is a schematic view of a pump head assembly of an emulsion plunger pump according to an embodiment of the present disclosure.

A pump head assembly of the emulsion pump has a chamber structure, and a liquid suction valve component, a liquid discharge valve component and a spacer sleeve are arranged in the chamber. In an existing plunger pump, a reset spring mounting seat of a liquid suction valve core is designed at a lower part of a liquid discharge valve core. On the one hand, the mass of the liquid discharge valve core is increased, causing large inertia force; on the other hand, a high-pressure liquid flow has impact on the liquid suction valve core and the liquid discharge valve core, resulting in a large force on a single side, and eccentric wear of a guide portion and hence of a sealing ring surface when the valve core rises or falls, which affects the service life. Additionally, in the existing plunger pump, the liquid suction valve component and the liquid discharge valve component in the pump head body are assembled from both sides of a pump head body. Consequently, during replacement of a liquid suction valve seat, the liquid suction valve core, a liquid discharge valve seat and the liquid discharge valve core, it is necessary to remove parts such as a liquid suction pipeline and a water suction box, which causes poor operability, long maintenance time and high maintenance cost.

The first technical problem to be solved by the present disclosure is related to the eccentric wear of the valve core and short service life due to the unreasonable internal structure of the pump head assembly of the existing plunger pump.

The present disclosure provides the following technical solutions directed at the above technical problem.

The technical solutions of the present disclosure will be described clearly and completely with respect to the accompany drawings. The described embodiments are part of rather than all of the embodiments of the present disclosure. Based on the embodiments in the present disclosure, all other embodiments obtained by those skilled in the art without creative effort fall into the protection scope of the present disclosure.

In the description of the present disclosure, it should be appreciated that terms such as "center," "upper," "lower," "left," "right," "vertical," "horizontal," "inner" and "outer" are construed to refer to the orientation or positions as then described or as shown in the drawings under discussion. These terms are only for the convenience of describing the present disclosure and simplifying the description, and do not indicate or imply that the device or element referred to must have a particular orientation and be constructed or operated in a particular orientation. Thus, these terms shall not be construed as limitation on the present disclosure. In addition, terms such as "first," "second" and "third" are only used for purposes of description and cannot be understood as indicating or implying relative importance.

In the description of the present disclosure, it should be noted that unless specified or limited otherwise, terms "mounted," "connected," and "coupled" should be understood broadly, and may be, for example, fixed connection, detachable connection or integrated connection; may also be direct connections or indirect connections via intervening structures; and may also be inner connection of two elements. For those skilled in the art, the specific meanings of the above terms in the present disclosure can be understood according to specific situations.

In addition, technical features involved in different embodiments of the present disclosure described below can be combined with each other as long as they do not conflict with each other.

FIG. 1 illustrates a specific embodiment of a pump head assembly of an emulsion plunger pump according to the present disclosure. The pump head assembly 100 includes a pump head body 101 with a hollow chamber 101*a*, a liquid suction valve component 102, a spacer sleeve component 104 and a liquid discharge valve component 103, all of which are mounted in the hollow chamber 101*a* in sequence from bottom to top. The pump head assembly 100 further includes an end cover 105 configured to seal the hollow chamber 101*a* and detachably connected to an upper end of the pump heat body 101.

The liquid suction valve component 102 includes a liquid suction valve seat 1021, a liquid suction valve core 1022 and a first reset spring 1023. The liquid suction valve core 1022 is slidably connected to the spacer sleeve component 104, and the first reset spring 1023 is between the spacer sleeve component 104 and the liquid suction valve core 1022.

In the above-mentioned pump head assembly 100, the liquid suction valve component 102 and the liquid discharge valve component 103 are separated by the spacer sleeve component 104; the liquid suction valve core 1022 is slidably connected to the spacer sleeve component 104; and the first reset spring 1023 is between the spacer sleeve component 104 and the liquid suction valve core 1022, so that the liquid suction valve core 1022 is not affected by the action of the liquid discharge valve core when being reset, and the liquid suction valve core 1022 is reliably closed. At the same time, since the liquid suction valve core 1022 is arranged on an upper side of the liquid suction valve seat 1021 and is slidably connected to the spacer sleeve component 104, the liquid suction valve core 1022 is less impacted during liquid suction and has a longer service life, compared with the liquid suction valve core 1022 being arranged on a lower side of the liquid suction valve seat 1021.

Figure 7:
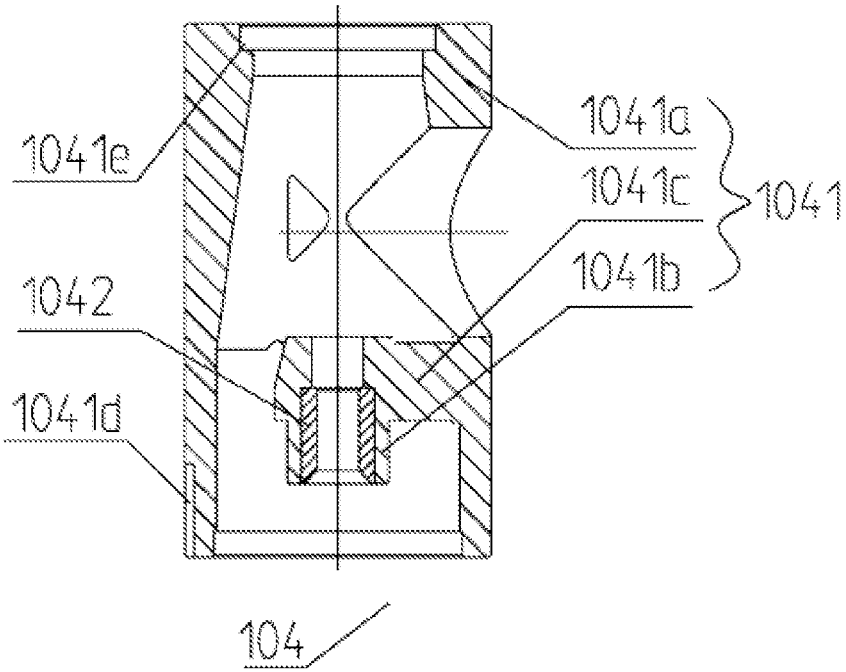
FIG. 7 is a schematic view of a spacer sleeve component according to an embodiment of the present disclosure.

Specifically, as shown in FIG. 7, the spacer sleeve component 104 includes a spacer sleeve body 1041 and a sliding sleeve 1042 fixedly connected to the spacer sleeve body 1041, and the liquid suction valve core 1022 is slidably connected to the sliding sleeve 1042. More specifically, the sliding sleeve 1042 is made of a soft copper sleeve, and the sliding of the liquid suction valve core 1022 relative to the copper sleeve can reduce its own wear and prolong the service life of the liquid suction valve core 1022.

Specifically, as shown in FIG. 7, the spacer sleeve body 1041 includes an outer sleeve 1041*a* in clearance fit with an inner wall of the hollow chamber 101*a*, an inner sleeve 1041*b* in interference fit with the sliding sleeve 1042, and a transition connection portion 1041*c* configured to connect the outer sleeve 1041*a* and the inner sleeve 1041*b*. The outer sleeve 1041*a* is configured to isolate the liquid suction valve component 102 from the liquid discharge valve component 103, and the inner sleeve 1041*b* is configured to mount the sliding sleeve 1042 to achieve sliding fit with the liquid suction valve core 1022.

The spacer sleeve body 1041 adopts the structure of inner and outer sleeves, so that the liquid suction valve core 1022 can reliably slide along the inner sleeve 1041*b* of the spacer sleeve body 1041, and the radial shaking of the liquid suction valve core 1022 relative to the liquid suction valve seat 1021 in the related art can be avoided.

Specifically, the pump head body 101 includes a pump head connection hole for connection with a hydraulic conversion assembly 200; the spacer sleeve body 1041 includes a spacer sleeve connection hole corresponding to the pump head connection hole; and a part of the hydraulic conversion assembly 200 extends into the hollow chamber 101*a* along the pump head connection hole and the spacer sleeve connection hole. The hydraulic conversion assembly 200 is configured to convert mechanical power of a crankcase into hydraulic changes of the pump head assembly 100.

More specifically, the hydraulic conversion assembly 200 can extend into the hollow chamber 101*a* only when the spacer sleeve connection hole is opposite to the pump head connection hole. In order to prevent the spacer sleeve body 1041 from rotating along an axial direction of the hollow chamber 101*a*, an outer wall of the spacer sleeve body 1041 includes an anti-rotation groove 1041*d*, the pump head body 101 includes a first connection hole extending in a radial direction, and the spacer sleeve body 1041 is positioned by a positioning member 106 inserted into the anti-rotation groove 1041*d* through the first connection hole.

In an embodiment, the positioning member 106 is a positioning pin, and since the hollow chamber 101*a* needs to be kept in a sealed state in a working state, a sealing member is arranged between the positioning member 106 and the pump head body 101 to ensure the sealing. In another embodiment, the positioning member 106 is a positioning screw, the first connection hole is a threaded hole, and the positioning screw is threadedly connected to the pump head body 101, with an end inserted into the anti-rotation groove 1041*d* to realize positioning; in order to achieve sealing, a sealing ring is arranged between a head of the positioning screw and the pump head body 101.

Figure 2:
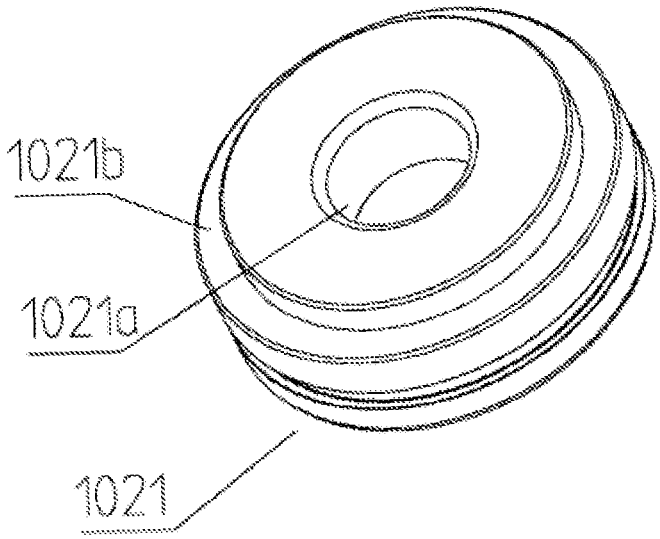
FIG. 2 is a schematic view of a liquid suction valve seat according to an embodiment of the present disclosure.

Specifically, as shown in FIG. 2, the liquid suction valve seat 1021 is formed as a plate body with a liquid suction through hole 1021*a* in the center; an annular groove 1021*b* is formed on one side of the plate body; and the outer sleeve 1041*a* of the spacer sleeve body 1041 is inserted into the annular groove 1021*b*. The positioning of the spacer sleeve body 1041 is more convenient due to the annular groove

1021*b*. More specifically, the liquid suction valve seat 1021 is sealed and connected to the pump head body 101 through a sealing ring 107.

Figure 3:
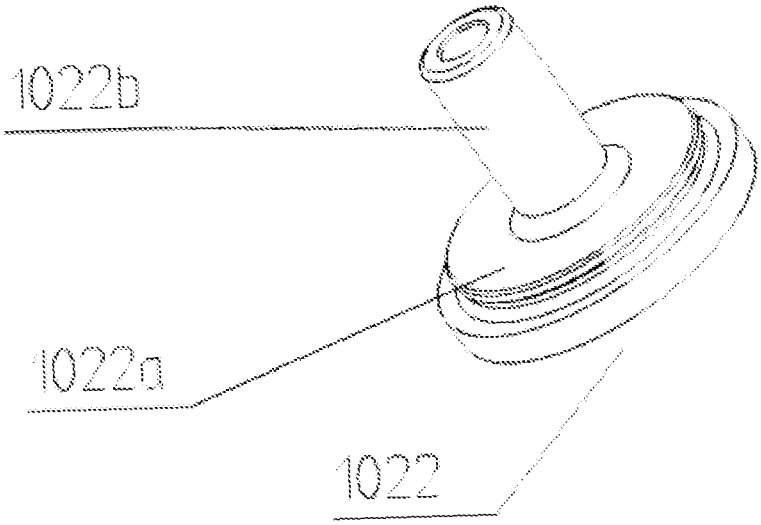
FIG. 3 is a schematic view of a liquid suction valve core according to an embodiment of the present disclosure.

As shown in FIG. 3, the liquid suction valve core 1022 includes a valve core plug 1022*a* configured to cooperate with the liquid suction through hole 1021*a* of the liquid suction valve seat 1021, and a valve core sliding portion 1022*b* configured to cooperate with the sliding sleeve 1042. The valve core plug 1022*a* is formed as a circular flat body larger than the liquid suction through hole 1021*a*, and the valve core sliding portion 1022*b* is formed as a sliding rod extending along the axial direction of the hollow chamber 101*a*. Under the action of hydraulic force, the valve core can slide axially in the sliding sleeve 1042 to open or block the liquid suction through hole 1021*a* of the liquid suction valve seat 1021.

Figure 4:
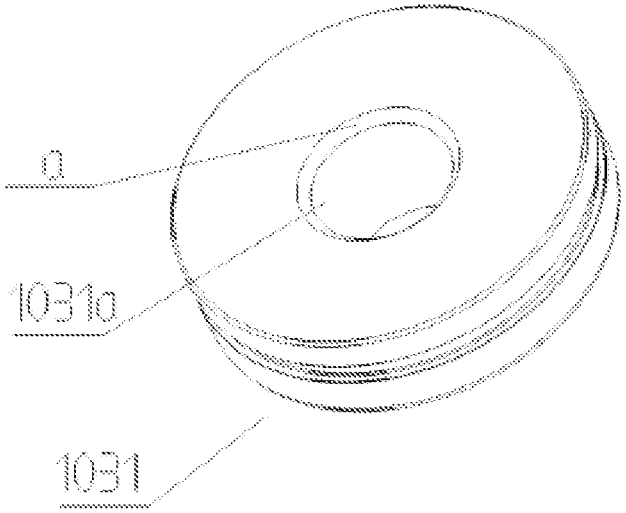
FIG. 4 is a schematic view of a liquid discharge valve seat according to an embodiment of the present disclosure.
Figure 5:
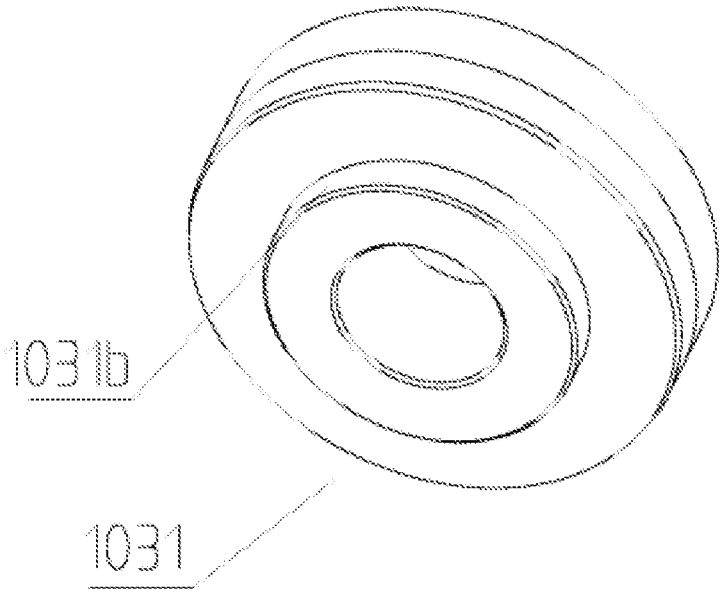
FIG. 5 is another schematic view of a liquid discharge valve seat according to an embodiment of the present disclosure.
Figure 6:
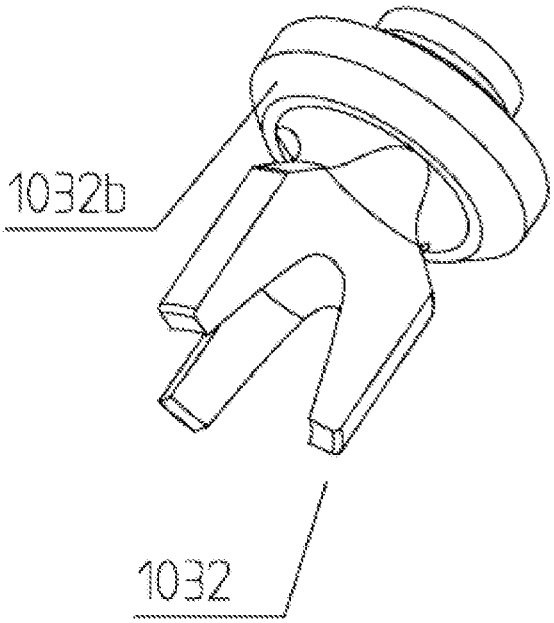
FIG. 6 is a schematic view of a liquid discharge valve core according to an embodiment of the present disclosure.

Specifically, the liquid discharge valve component 103 includes a liquid discharge valve seat 1031, a liquid discharge valve core 1032, a liquid discharge valve core check valve 1034 and a second reset spring 1033. As shown in FIGS. 4 and 5, the liquid discharge valve seat 1031 includes a liquid discharge through hole 1031*a*, and the liquid discharge through hole 1031*a* includes a first conical surface a. As shown in FIG. 6, the liquid discharge valve core 1032 is slidably connected to the liquid discharge through hole 1031*a* of the liquid discharge valve seat 1031, and the liquid discharge valve core 1032 includes a second conical surface b fitted with the first conical surface a. The liquid discharge valve core check valve 1034 is arranged between the liquid discharge valve plug 1032 and the end cover 105. A first end of the second reset spring 1033 is fitted over the liquid discharge valve core 1032, and a second end of the second reset spring 1033 abuts against the liquid discharge valve core check valve 1034. More specifically, sealing connection between the liquid discharge valve seat 1031 and the pump head body 101, and sealing connection between the liquid discharge valve core check valve 1034 and the pump head body 101 are realized by the sealing rings 107.

Since the pressure of emulsion is relatively high when the liquid discharge valve component 103 performs discharge, the liquid discharge valve core 1032 and the liquid discharge valve seat 1031 are subjected to relatively large impact. The sealing performance between the liquid discharge valve core 1032 and the liquid discharge valve seat 1031 is better through the conical surface fit, and at the same time, self-compensation can be realized after wear, thus prolonging the service life. The pressure of emulsion is relatively low when the liquid suction valve component 102 performs suction. Consequently, in the present disclosure, in the liquid suction valve component 102, the liquid suction valve seat 1021 and the liquid suction valve core 1022 adopt a planar fit; in the liquid discharge valve component 103, the liquid discharge valve core 1032 and the liquid discharge valve seat 1031 adopt the conical surface fit, which can make the service life of the liquid discharge valve component 103 equal to the service life of the liquid suction valve component 102, and can maintain and replace the liquid discharge valve component and the liquid suction valve component at the same time, avoiding the waste of components caused by different use conditions of various components when being replaced, due to a large difference in the service life of the components.

In order to further improve the installation and positioning of the liquid discharge valve component 103, a positioning structure is arranged between the spacer sleeve body 1041 and the liquid discharge valve seat 1031. The positioning structure includes a positioning protrusion or a positioning groove arranged on the spacer sleeve body 1041; and a positioning groove or a positioning protrusion correspondingly arranged on the liquid discharge valve seat 1031. More specifically, as shown in FIG. 6, an inner wall of the outer sleeve 1041*a* of the spacer sleeve body 1041 includes a positioning groove 1041*e*, and the liquid discharge valve seat 1031 includes a positioning protrusion 1031*b* at a corresponding position. In order to further prevent the liquid discharge valve seat 1031 from rotating in the hollow chamber 101*a*, the positioning groove 1041*e* is integrally formed as a square groove, and the positioning protrusion 1031*b* of the liquid discharge valve seat 1031 is a square protrusion fitted with the square groove.

Figure 8:
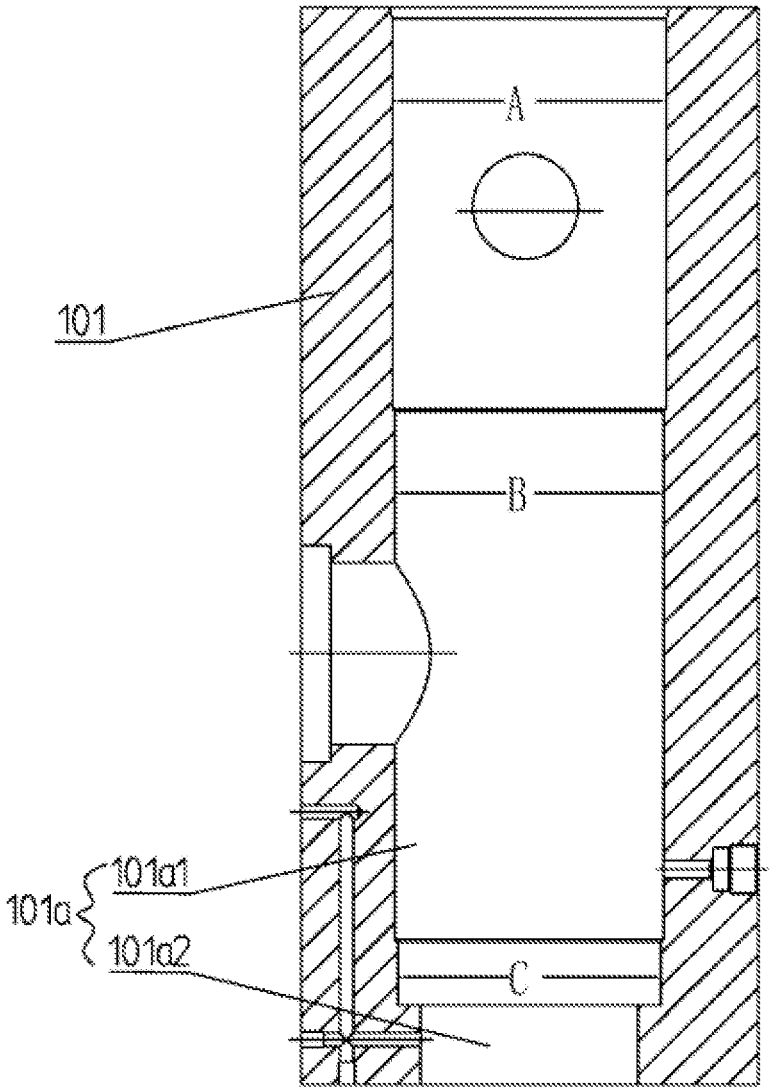
FIG. 8 is a schematic view of a pump head body according to an embodiment of the present disclosure.

The liquid discharge valve component 103, the spacer sleeve component 104 and the liquid suction valve component 102 are all mounted from a liquid discharge side of the hollow chamber 101*a*, so that the pump head body 101 can be overhauled without disassembling oil supply pipelines. Consequently, as shown in FIG. 8, the inner wall of the hollow chamber 101*a* includes a first step that divides the hollow chamber 101*a* into a first chamber 101*a*1 and a second chamber 101*a*2; an inner diameter of the first chamber 101*a*1 is larger than an inner diameter of the second chamber 101*a*2; the liquid suction valve component 102, the spacer sleeve component 104 and the liquid discharge valve component 103 are mounted in the first chamber 101*a*1; and the second chamber 101*a*2 is in connection with a liquid suction box component 108.

More specifically, the first chamber 101*a*1 may be formed as a chamber with a constant inner diameter from top to bottom, or may be provided with a plurality of stepped mounting surfaces with different inner diameters. In the first chamber 101*al*, an inner diameter C of a first portion for mounting the liquid suction valve component 102 is smaller than an inner diameter B of a second portion for mounting the spacer sleeve component 104; and the inner diameter B of the second portion for mounting the spacer sleeve component 104 is smaller than an inner diameter A of a third portion for mounting the liquid discharge valve component 103. The liquid suction valve component 102, the spacer sleeve component 104 and the liquid discharge valve component 103 can be assembled and disassembled through an opening at the upper end of the pump head body 101, which is convenient and quick.

The present disclosure also provides a specific embodiment of a plunger pump adopting the above-mentioned pump head assembly 100, and the plunger pump according to this embodiment is a five-plunger emulsion pump. The plunger pump includes three parts. The first part is a crankcase assembly 300 connected to a main drive motor to transmit power. The second part is the pump head assembly 100 for pumping emulsion. The third part is the hydraulic conversion assembly 200 for converting the mechanical power of the crankcase into hydraulic changes of the pump head assembly 100, in which a first end of the hydraulic conversion assembly 200 is connected to the crankcase assembly 300 and a second end thereof is connected to the pump head assembly 100.

There is a gap with a predetermined distance between the crankcase assembly 300 and the pump head assembly 100, and the hydraulic conversion assembly 200 can be disassembled or mounted from the gap between the crankcase assembly 300 and the pump head assembly 100.

During operation of the plunger pump, a rotary motion input by the main drive motor drives an input crankshaft connecting rod to rotate, which is converted into a reciprocating linear motion of a plunger in the hydraulic conversion assembly 200, so that a volume of a cavity in the pump head assembly 100 changes. When the plunger is at a farthest end, the volume of the cavity is increased to form a negative pressure, the liquid suction valve core 1022 is opened, and the liquid discharge valve core 1032 is closed, in which way a liquid suction process is completed. When the plunger moves to a nearest end, the volume of the cavity is reduced, compressing the sucked liquid and forming high-pressure liquid, the liquid suction valve core 1022 is closed, and the liquid discharge valve core 1032 is opened to discharge the high-pressure liquid, in which way a liquid discharge is completed. The conical surface sealing between the liquid discharge valve core 1032 and the liquid discharge valve seat 1031 of the pump head assembly 100 ensures the high volumetric efficiency of the five-plunger pump, thus meeting actual liquid supply requirements of the hydraulic system for the fully mechanized mining face with super high mining height.

Compared with the related art, the technical solutions of the present disclosure has the following technical effects.

In the pump head assembly of the emulsion plunger pump according to the present disclosure, the liquid suction valve component and the liquid discharge valve component are separated by the spacer sleeve component; the liquid suction valve core is slidably connected to the spacer sleeve component; and the first reset spring is between the spacer sleeve component and the liquid suction valve core, so that the liquid suction valve core is not affected by the action of the liquid discharge valve core when being reset, and the liquid suction valve core is reliably closed. At the same time, since the liquid suction valve core is slidably connected to the spacer sleeve component and is arranged on a side of the liquid suction valve seat away from a liquid suction box component, the liquid suction valve core is less impacted during liquid suction and has a longer service life.

Further, in the pump head assembly of the emulsion plunger pump according to the present disclosure, the liquid suction valve seat and the liquid suction valve core of the liquid suction valve component adopts the planar fit, and the liquid discharge valve core and the liquid discharge valve seat of the liquid discharge valve component adopts the conical surface fit, which can make the service life of the liquid discharge valve component equal to the service life of the liquid suction valve component, and can maintain and replace the liquid discharge valve component and the liquid suction valve component at the same time, avoiding the waste of components caused by different use conditions of various components when being replaced, due to a large difference in the service life of the components.

Further, in the pump head assembly of the emulsion plunger pump according to the present disclosure, the inner wall of the hollow chamber includes the first step that divides the hollow chamber into the first chamber and the second chamber; the inner diameter of the first chamber is greater than that of the second chamber; the liquid suction valve component, the spacer sleeve component and the liquid discharge valve component are mounted in the first chamber; and the second chamber is configured for connection with the liquid suction box component. In this way, the liquid discharge valve component, the spacer sleeve component and the liquid suction valve component are all mounted from a liquid discharge side of the hollow chamber. During maintenance, the pump head body can be repaired without removing oil supply pipelines.

The above-mentioned embodiments are merely examples for clear explanation, rather than limitations on the implementations. For those skilled in the art, other variations or changes in different forms can be made based on the above description. It is not necessary and impossible to exhaust all the embodiments here. However, the obvious variations or changes caused resulting therefrom are still within the protection scope of the present disclosure.

The invention claimed is:

1. A pump head assembly of an emulsion plunger pump, the pump head assembly comprising:

a pump head body having a hollow chamber;

a liquid suction valve component;

a liquid discharge valve component;

a spacer sleeve component; and an end cover detachably connected to an end of the pump head body, the end cover being configured to close the hollow chamber, wherein the liquid suction valve component, the spacer sleeve component and the liquid discharge valve component are sequentially mounted in the hollow chamber, wherein the liquid suction valve component comprises a liquid suction valve seat, a liquid suction valve core and a first reset spring, the liquid suction valve core being slidably connected to the spacer sleeve component, the first reset spring being disposed between the spacer sleeve component and the liquid suction valve core, wherein the spacer sleeve component comprises a spacer sleeve body and a sliding sleeve fixedly connected to the spacer sleeve body, wherein the liquid suction valve core is slidably connected to the sliding sleeve, wherein an outer wall of the spacer sleeve body comprises an anti-rotation groove, wherein the pump head body comprises a first connection hole extending in a radial direction, and wherein the spacer sleeve body is positioned by a positioning member inserted into the anti-rotation groove through the first connection hole.

2. A pump head assembly of an emulsion plunger pump, the pump head assembly comprising:

a pump head body having a hollow chamber;

a liquid suction valve component;

a liquid discharge valve component;

a spacer sleeve component; and an end cover detachably connected to an end of the pump head body, the end cover being configured to close the hollow chamber, wherein the liquid suction valve component, the spacer sleeve component and the liquid discharge valve component are sequentially mounted in the hollow chamber, wherein the liquid suction valve component comprises a liquid suction valve seat, a liquid suction valve core and a first reset spring, the liquid suction valve core being slidably connected to the spacer sleeve component, the first reset spring being disposed between the spacer sleeve component and the liquid suction valve core, wherein the spacer sleeve component comprises a spacer sleeve body and a sliding sleeve fixedly connected to the spacer sleeve body, wherein the liquid suction valve core is slidably connected to the sliding sleeve, wherein the spacer sleeve body comprises:

an outer sleeve in clearance fit with an inner wall of the hollow chamber;

an inner sleeve in interference fit with the sliding sleeve; and a transition connection portion configured to connect the outer sleeve and the inner sleeve.

3. The pump head assembly according to claim 2, wherein the liquid suction valve seat has a plate body having a liquid suction through hole in a center of the plate body, wherein an annular groove is defined on one side of the plate body, and wherein the outer sleeve of the spacer sleeve body is inserted into the annular groove.

4. The pump head assembly according to claim 3, wherein the liquid suction valve core comprises:

a valve core plug having a flat body larger than the liquid suction through hole; and a valve core sliding portion having a sliding rod extending along an axial direction of the hollow chamber.

5. The pump head assembly according to claim 2, wherein the liquid discharge valve component comprises:

a liquid discharge valve seat comprising a liquid discharge through hole having a first conical surface;

a liquid discharge valve core slidably connected to the liquid discharge through hole of the liquid discharge valve seat, the liquid discharge valve core comprising a second conical surface fitted with the first conical surface;

a liquid discharge valve core check valve disposed between the liquid discharge valve core and the end cover; and a second reset spring having a first end fitted over the liquid discharge valve core and a second end abutting against the liquid discharge valve core check valve.

6. The pump head assembly according to claim 5, wherein a positioning structure is arranged between the spacer sleeve body and the liquid discharge valve seat, and wherein the positioning structure comprises:

a positioning protrusion or a positioning groove arranged on the spacer sleeve body; and a positioning groove or a positioning protrusion correspondingly arranged on the liquid discharge valve seat.

7. The pump head assembly according to claim 2, wherein an inner wall of the hollow chamber comprises a first step surface, the first step surface dividing the hollow chamber into a first chamber and a second chamber, wherein an inner diameter of the first chamber is larger than an inner diameter of the second chamber, and wherein the liquid suction valve component, the spacer sleeve component and the liquid discharge valve component are mounted in the first chamber.

* * * * *